US005440884A

United States Patent [19]

Bonaquist et al.

[11] Patent Number: 5,440,884

[45] Date of Patent: Aug. 15, 1995

[54] CRYOGENIC AIR SEPARATION SYSTEM WITH LIQUID AIR STRIPPING

[75] Inventors: Dante P. Bonaquist; Michael J. Lockett, both of Grand Island, N.Y.

[73] Assignee: Praxair Technology, Inc., Danbury, Conn.

[21] Appl. No.: 274,885

[22] Filed: Jul. 14, 1994

[51] Int. Cl.[6] ..... F25J 3/04

[52] U.S. Cl. ..... 62/22; 62/25; 62/38; 62/41

[58] Field of Search ..... 62/22, 24, 25, 38, 41

[56] References Cited

U.S. PATENT DOCUMENTS 2,316,056 4/1943 De Baufre ..... 62/175.5
4,715,874 12/1987 Erickson ..... 62/22
4,737,177 4/1988 Erickson ..... 62/22
5,019,145 5/1991 Rohde et al. ..... 62/22
5,098,456 3/1992 Dray et al. ..... 62/24
5,108,476 4/1992 Dray et al. ..... 62/24
5,114,449 5/1992 Agawal et al. ..... 62/22
5,114,452 5/1992 Dray ..... 62/24
5,245,832 9/1993 Roberts ..... 62/22
5,265,429 11/1993 Dray ..... 62/38
5,291,737 3/1994 Chamberlein et al. ..... 62/41

*Primary Examiner*—Ronald C. Capossela
*Attorney, Agent, or Firm*—Stanley Ktorides

[57] ABSTRACT

A cryogenic rectification system which advantageously separates feed air wherein the thermodynamic irreversibility of the argon column top condenser and the lower pressure column is reduced by using a stripping column upstream of the double column main plant.

16 Claims, 4 Drawing Sheets

CRYOGENIC AIR SEPARATION SYSTEM WITH LIQUID AIR STRIPPING

TECHNICAL FIELD

This invention relates generally to the cryogenic rectification of feed air and more particularly to the cryogenic rectification of feed air employing a double column system with an associated argon side arm column.

BACKGROUND ART

The cryogenic rectification of air to produce oxygen, nitrogen and/or argon is a well established industrial process. Typically the feed air is separated into nitrogen and oxygen in a double column system wherein nitrogen-rich top vapor from a higher pressure column is used to reboil oxygen-rich bottom liquid in a lower pressure column. Fluid from the lower pressure column is passed into an argon side arm column for the production of argon.

A significant thermodynamic irreversibility present in a double column cryogenic air separation system with a side arm column attached to the lower pressure column for the production of argon is the large temperature difference between the boiling kettle liquid and condensing argon in the argon column top condenser. This temperature difference can be greater than 5 degrees C. compared with a temperature difference of less than 1.5 degrees C. which is common for the main condenser linking the higher and lower pressure columns. The magnitude of the lost work owing to the argon condenser irreversibility is large in comparison to the gain in efficiency from other improvements to modern air separation systems. For this reason, a modified cryogenic air separation system wherein the size of this irreversibility is reduced would clearly be useful.

Accordingly, it is an object of this invention to provide an improved cryogenic rectification system wherein the thermodynamic irreversibility between the argon column top condenser and the lower pressure column is reduced.

SUMMARY OF THE INVENTION

The above and other objects, which will become apparent to one skilled in the art upon a reading of this disclosure, are attained by the present invention, one aspect of which is:

A method for the cryogenic rectification of feed air employing a double column main plant, comprising a higher pressure column and a lower pressure column, and an argon column having a top condenser, comprising:

(A) condensing a portion of the feed air to produce liquid feed air;

(B) passing liquid feed air and gaseous feed air into a stripping column and passing liquid feed air against gaseous feed air in the stripping column to produce stripping column product gas, having a nitrogen concentration which exceeds that of air, and stripping column product liquid, having an oxygen concentration which exceeds 25 mole percent;

(C) passing stripping column product gas into the higher pressure column for separation by cryogenic rectification;

(D) at least partially vaporizing stripping column product liquid by indirect heat exchange with argon-containing fluid in the argon column top condenser to produce oxygen-containing gas; and (E) passing oxygen-containing gas into the lower pressure column for separation by cryogenic rectification.

Another aspect of the invention is:

A cryogenic rectification apparatus comprising:

(A) a double column main plant comprising a first column and a second column, and an argon column having a top condenser;

(B) a stripping column, means for passing liquid into the upper portion of the stripping column, and means for passing gas into the lower portion of the stripping column;

(C) means for passing fluid from the upper portion of the stripping column into the first column;

(D) means for passing fluid from the lower portion of the stripping column into the top condenser; and (E) means for passing fluid from the top condenser into the second column.

As used herein, the term "feed air" means a mixture comprising primarily nitrogen, oxygen and argon, such as air.

As used herein, the terms "turboexpansion" and "turboexpander" mean respectively method and apparatus for the flow of high pressure gas through a turbine to reduce the pressure and the temperature of the gas thereby generating refrigeration.

As used herein, the term "column" means a distillation or fractionation column or zone, i.e., a contacting column or zone wherein liquid and vapor phases are countercurrently contacted to effect separation of a fluid mixture, as for example, by contacting of the vapor and liquid phases on a series of vertically spaced trays or plates mounted within the column and/or on packing elements such as structured or random packing. For a further discussion of distillation columns, see the Chemical Engineer's Handbook fifth edition, edited by R. H. Perry and C. H. Chilton, McGraw-Hill Book Company, New York, Section 13, *The Continuous Distillation Process.* The term, double column is preferably used to mean a higher pressure column having its upper end in heat exchange relation with the lower end of a lower pressure column. A further discussion of double columns appears in Ruheman "The Separation of Gases", Oxford University Press, 1949, Chapter VII, Commercial Air Separation. Other double column arrangements that utilize the combination of a higher pressure column and a lower pressure column can also be used in the practice of this invention.

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is adiabatic and can include integral or differential contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin (K).

As used herein, the term "indirect heat exchange" means the bringing of two fluid streams into heat exchange relation without any physical contact or intermixing of the fluids with each other.

As used herein, the term "argon column" means a column which processes a feed comprising argon and produces a product having an argon concentration which exceeds that of the feed.

As used herein the term "top condenser" means a heat exchange device which generates column downflow liquid from column top vapor.

As used herein, the terms "upper portion" and "lower portion" mean those sections of a column respectively above and below the midpoint of the column.

As used herein, the term "structured packing" means packing wherein individual members have specific orientation relative to each other and to the column axis. Examples of structured packing are disclosed in U.S. Pat. No. 4,186,159-Huber, U.S. Pat. No. 4,296,050-Meier, U.S. Pat. No. 4,929,399-Lockett, et al. and U.S. Pat. No. 5,132,056-Lockett et al.

As used herein the term "liquid nitrogen" means a liquid having a nitrogen concentration of at least 78 mole percent.

As used herein the term "liquid oxygen" means a liquid having an oxygen concentration of at least 20 mole percent.

As used herein the term "equilibrium stage" means a contact process between vapor and liquid such that the exiting vapor and liquid streams are in equilibrium.

As used herein the term "subcooling" means cooling a liquid to be at a temperature lower than that liquid's saturation temperature for the existing pressure.

As used herein the term "stripping column" means a column wherein liquid is introduced into the upper portion of the column and more volatile component(s) are removed or stripped from descending liquid by rising vapor.

DETAILED DESCRIPTION

The present invention is a system for cryogenic air separation in which a liquid, generally having a larger mole fraction of oxygen than liquid from the sump of the higher pressure column of a conventional system, is boiled in the top condenser of the argon column. The invention uses a relatively short stripping column to increase the nitrogen content of the vapor entering the bottom of the higher pressure column and to provide a liquid of increased oxygen mole fraction for use in the argon column top condenser. The liquid from the sump of the higher pressure column, kettle liquid, is not vaporized or partially vaporized in the argon column top condenser but, rather, is subcooled and introduced into the lower pressure column at a point above the point where the kettle liquid and vaporized kettle liquid are typically introduced in conventional processes. This liquid serves as an intermediate reflux stream which increases the degree of separation in the lower pressure column by relieving a pinch which usually occurs just above the point where the kettle liquid and vaporized kettle liquid typically enter the low pressure column of conventional processes. The increased degree of separation is manifest as a larger fraction of the argon entering with the feed air being recovered at a given purity with columns of a given height, or an increase in argon purity at fixed recovery and column height or as a decrease in the required column height at fixed recovery and purity. Thus, the previous thermodynamic irreversibility of the argon column top condenser is at least partially reduced to increase argon recovery or argon purity or to reduce column height.

Figure 1:
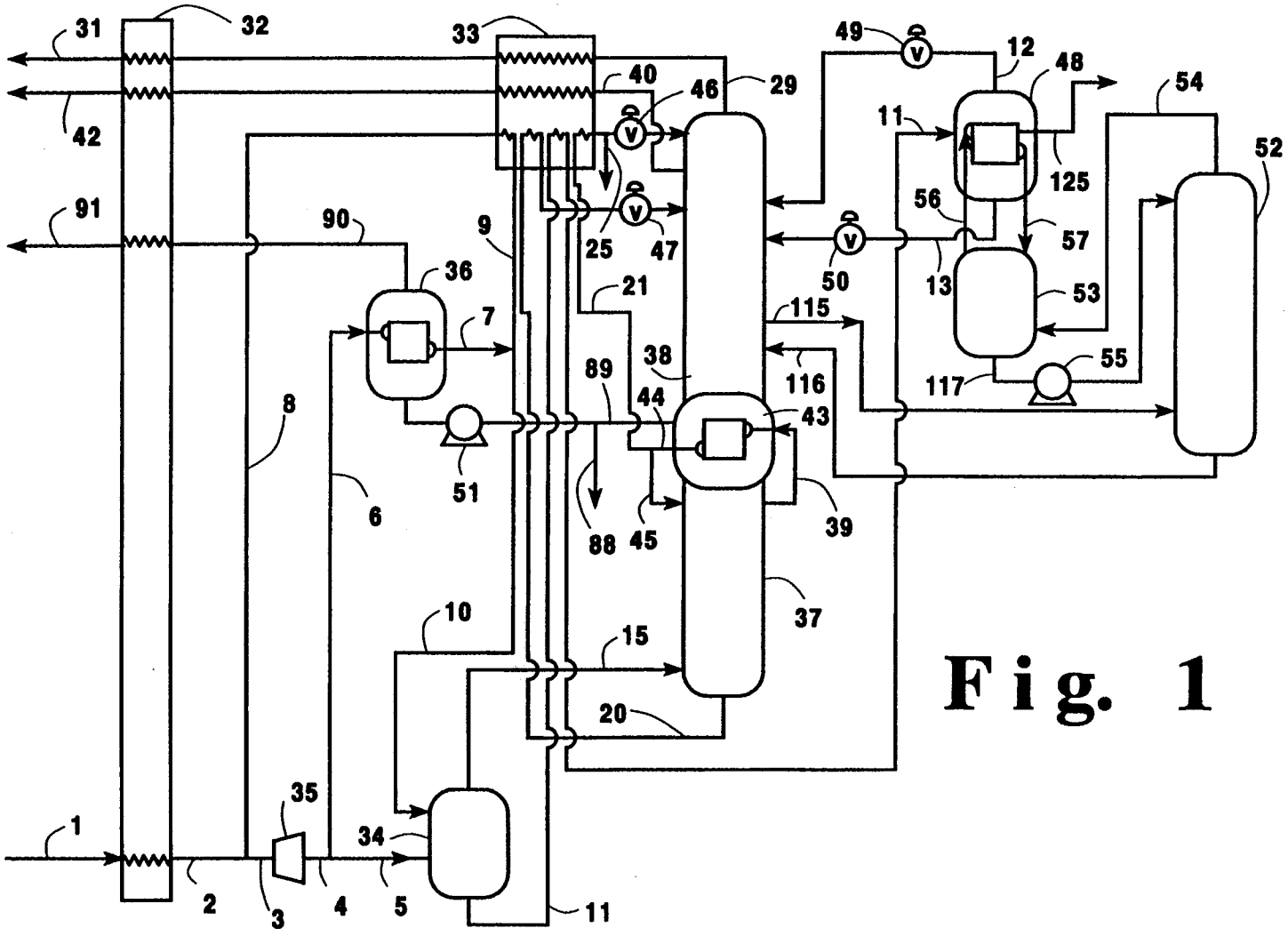
FIGS. 1–4 are each schematic flow diagrams of preferred embodiments of the cryogenic rectification system of this invention.

The invention will be described in greater detail with reference to the Drawings. FIG. 1 illustrates a particularly preferred embodiment of the invention. Referring now to FIG. 1, feed air 1, at a pressure generally within the range of from 70 to 500 pounds per square inch absolute (psia), is cooled by indirect heat exchange with return streams in main heat exchanger 32. Resulting cooled feed air stream 2 may be divided into major portion 3 and minor portion 8. Minor portion 8, which comprises from 0 to 10 percent of the total feed air passed into the system is liquefied by indirect heat exchange with return streams in heat exchanger 33 and resulting stream 9 from heat exchanger 33 is passed into stripping column 34 as will be described more fully later. Major portion 3 is turboexpanded in turboexpander 35 to generate refrigeration and resulting stream 4 is divided into minor portion 6 and major portion 5.

Stream 6, which comprises from about 20 to 45 percent of the total feed air employed in the system, i.e., the total feed air fed into the double column main plant, is passed to product boiler 36 wherein it is condensed by indirect heat exchange with boiling liquid oxygen. Resulting liquid feed air 7 is passed into the upper portion of stripping column 34. In the preferred embodiment illustrated in FIG. 1, stream 7 is combined with stream 9 to form stream 10 which is then passed into the upper portion of stripping column 34. Gaseous feed air stream 5 is passed into the lower portion of stripping column 34.

Stripping column 34 is a relatively small column, generally having from about 1 to 10 equilibrium stages and typically having about 5 equilibrium stages. Within stripping column 34 the liquid feed air is passed down against upflowing gaseous feed air and, in the process, nitrogen is stripped from the descending liquid into the upflowing gas, resulting in the production of stripping column product gas, having a nitrogen concentration which exceeds that of air, and stripping column product liquid having an oxygen concentration which exceeds that of air. Generally the nitrogen concentration of the stripping column product gas will be within the range of from 79 to 90 mole percent and preferably will exceed 85 mole percent. The oxygen concentration of the stripping column product liquid will be at least 25 mole percent, generally within the range of from greater than 33 to 45 mole percent and preferably will exceed 40 mole percent. Typically the oxygen concentration of kettle liquid passed from the higher pressure column to the argon column top condenser in a conventional system is only about 33 mole percent.

Stripping column product gas is passed in stream 15 from the upper portion of stripping column 34 into column 37 which is the first column or higher pressure column of a double column main plant comprising column 37 and second or lower pressure column 38. Column 37 is operating at a pressure generally within the range of from 70 to 150 psia. Within column 37 the stripping column product gas is separated by cryogenic rectification into nitrogen-enriched vapor and oxygen-enriched liquid. Nitrogen-enriched vapor is passed in line 39 into main condenser 43 wherein it is condensed by indirect heat exchange with column 38 bottom liquid. Resulting nitrogen-enriched liquid is passed out of main condenser 43 in stream 44. A portion 45 of the nitrogen-enriched liquid is passed back into higher pressure column 37 as reflux and another portion 21 of the nitrogen-enriched liquid is subcooled in heat exchanger 33 and passed through valve 46 into lower pressure column 38 as reflux. If desired, a portion of the nitrogen-enriched liquid, such as is shown by stream 25, may be recovered as product liquid nitrogen.

Oxygen-enriched liquid, having an oxygen-concentration generally within the range of from 22 to 32 mole percent, is withdrawn from the lower portion of column 37 as stream 20. The oxygen-enriched liquid will generally have an oxygen concentration less than higher pressure column kettle liquid of a conventional double column system. The oxygen-enriched liquid in stream 20 is subcooled in heat exchanger 33 and then passed through valve 47 and into lower pressure column 38 at a point below the point where nitrogen-enriched liquid stream 21 is passed into column 38.

Stripping column product liquid is withdrawn from the lower portion of stripping column 34 as stream 11, subcooled in subcooler or heat exchanger 33 against return streams, and passed into the boiling side of top condenser 48. Argon-containing vapor, having an argon concentration of at least 90 mole percent, is passed into the condensing side of top condenser 48 as will be more fully described later. Within top condenser 48 the stripping column product liquid is at least partially vaporized by indirect heat exchange with argon-containing fluid contained in top condenser 48. Resulting oxygen-containing gas is passed from top condenser 48 in stream 12 through valve 49 into lower pressure column 38 at a point below the point where higher pressure column kettle liquid is passed into column 38 in stream 20. Remaining oxygen-containing liquid may be passed from top condenser 48 in stream 13 through valve 50 into lower pressure column 38.

Lower pressure or second column 38 is operating at a pressure less than that of higher pressure or first column 37 and generally within the range of from 15 to 25 psia. Within column 38 the various feeds into the column are separated by cryogenic rectification into nitrogen-rich vapor and oxygen-rich liquid. Nitrogen-rich vapor is withdrawn from the upper portion of column 38 in stream 29, warmed by passage through heat exchangers 33 and 32 and withdrawn from the system in stream 31 which may be recovered as nitrogen gas product having a nitrogen concentration of 99 mole percent or more. For product purity control purposes a waste stream 40 may be withdrawn from column 38 below the point where stream 29 is withdrawn, warmed by passage through heat exchangers 33 and 32 and withdrawn from the system in stream 42.

Oxygen-rich liquid is vaporized to provide vapor upflow for column 38 against the condensing nitrogen-enriched vapor as was previously described. A portion of the resulting oxygen-rich gas may be recovered directly from column 38. FIG. 1 illustrates a preferred embodiment of the invention wherein oxygen-rich liquid is employed to carry out the condensation of a feed air portion to produce liquid feed air for passage into the stripping column. In this preferred embodiment a portion of the oxygen-rich liquid is withdrawn from column 38 or main condenser 43 as stream 89 and then passed into product boiler 36. If desired, the pressure of the oxygen-rich liquid may be increased by passage through liquid pump 51 or, alternatively, by liquid head due to an elevation difference between units 43 and 36. Also, if desired, a portion of the oxygen-rich liquid may be recovered as product liquid oxygen as shown by stream 88. Oxygen-rich liquid passed into product boiler 36 is vaporized in product boiler 36 against the foredescribed condensing feed air. Resulting oxygen-rich gas is withdrawn from product boiler 36 in stream 90, warmed by passage through main heat exchanger 32 and removed from the system as stream 91 which may be recovered as oxygen gas product having an oxygen concentration generally within the range of from 99 to 99.9 mole percent.

In the practice of this invention top condenser 48 is the top condenser of an argon column. The argon column may be a crude argon column, i.e. an argon column having from about 40 to 60 equilibrium stages, and producing crude argon having an argon concentration within the range of from 90 to 99 mole percent. Preferably the argon column is a refined argon column wherein structured packing is used as the column mass transfer internals enabling the operation of a column having 150 or more equilibrium stages and producing argon-containing fluid having an argon concentration of 99.999 mole percent or more. When such a large or super-staged argon column is used, it is preferred that the column be in two parts, and such a two part argon column is illustrated in the Drawings.

Referring back now to FIG. 1 the argon column is comprised of first part 52 and second part 53. A fluid containing from about 8 to 25 mole percent argon with the remainder mostly oxygen is passed in stream 115 from lower pressure column 38 into argon column first part 52 wherein it is separated by cryogenic rectification into oxygen-richer liquid and intermediate vapor. Oxygen- richer liquid is passed back into lower pressure column 38 from argon column first part 52 in stream 116. Intermediate vapor is passed in stream 54 from argon column first part 52 into argon column second part 53 wherein it is separated by cryogenic rectification into argon-containing vapor and intermediate liquid. Intermediate liquid is passed in line 117 from argon column second part 53 into argon column first part 52 as downflowing liquid for the cryogenic rectification. The liquid in stream 117 may be pumped by liquid pump 55 if required to reach the top of argon column first part 52. Generally, argon column first part 52 will have from 40 to 60 equilibrium stages and argon column second part 53 will have from 110 to 140 equilibrium stages.

Argon-containing vapor is passed from the argon column in line 56 into the condensing side of top condenser 48 wherein it is at least partially condensed against the aforesaid vaporizing stripping column product liquid. The argon-containing fluid within top condenser 48 may be crude argon or may be refined argon having an argon concentration of 99.999 mole percent or more, depending upon the type of argon column employed. Resulting condensed argon-containing fluid is returned in line 57 to the argon column for reflux. In the embodiment illustrated in FIG. 1 line 57 passes from top condenser 48 into argon column second part 53. A portion of the argon-containing fluid in either gaseous or liquid form is recovered as product as shown by line 125.

The invention enables improved performance, i.e. less work input over conventional processes, by using a liquid having a higher oxygen concentration as the boiling fluid within the argon column top condenser. This enables a reduction in the temperature difference associated with the argon column top condenser. Moreover, because the nitrogen mole fraction of the feed air passed into the higher pressure column is higher than in a conventional system, the kettle liquid passed from the higher pressure column into the lower pressure column also has a higher nitrogen concentration. This results in a better match with the composition of liquid within the lower pressure column, enhancing the separation performance of the lower pressure column. This increases the recovery or the purity of the argon produced in the argon column or enables comparable recovery or purity with reduced work input. For example, in comparison with a conventional double column system with an argon sidearm column and fixed net work input to the process, the additional separation provided by the present invention increase the argon recovery percentage from about 85 percent of the argon contained in the feed air stream to about 92 percent of the argon contained in the feed air stream for an identical number of equilibrium stages in all columns. Net work input can be reduced by about 3.5 percent compared with conventional systems for a fixed argon recovery.

Figure 2:
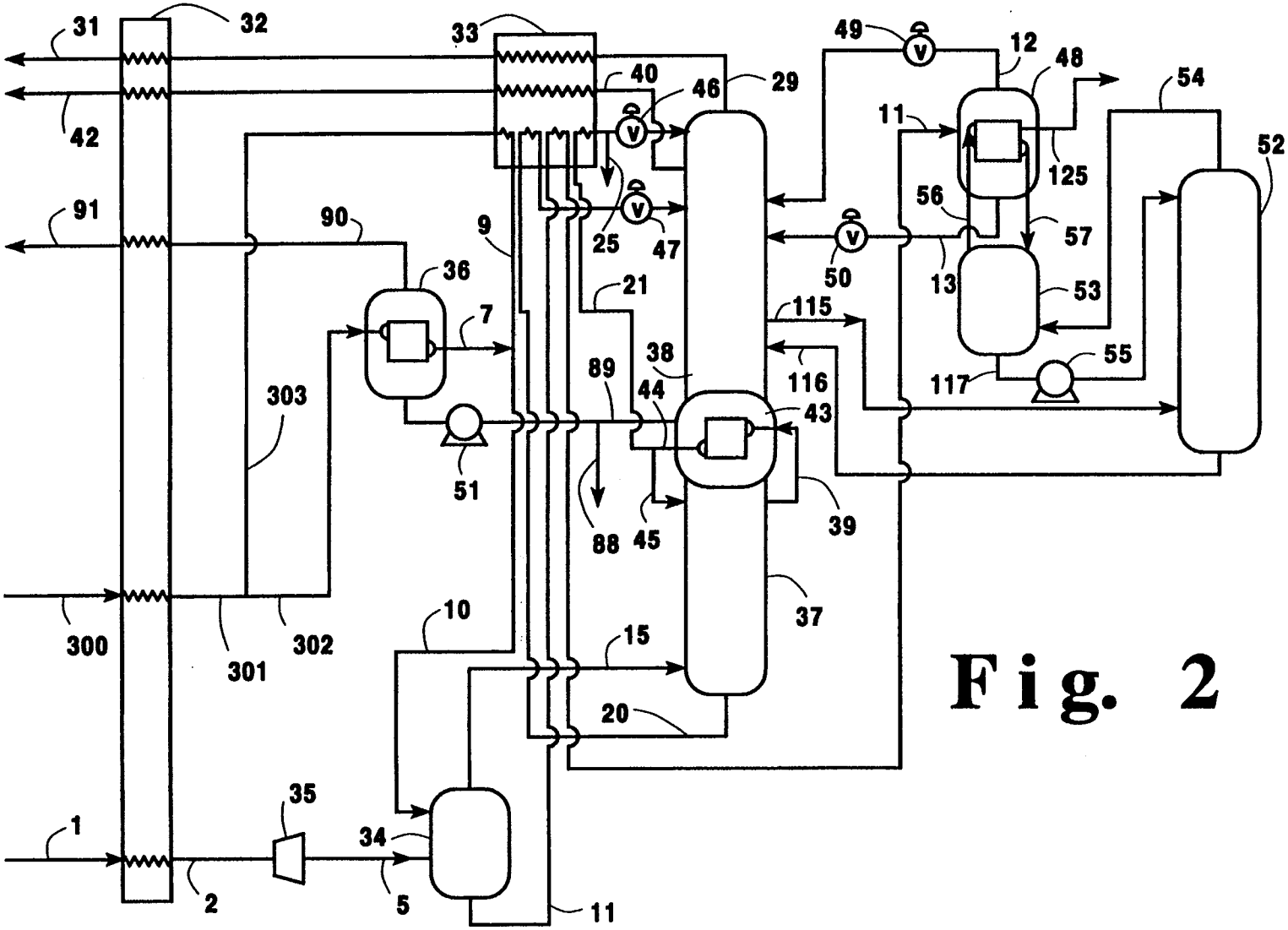
Figure 3:
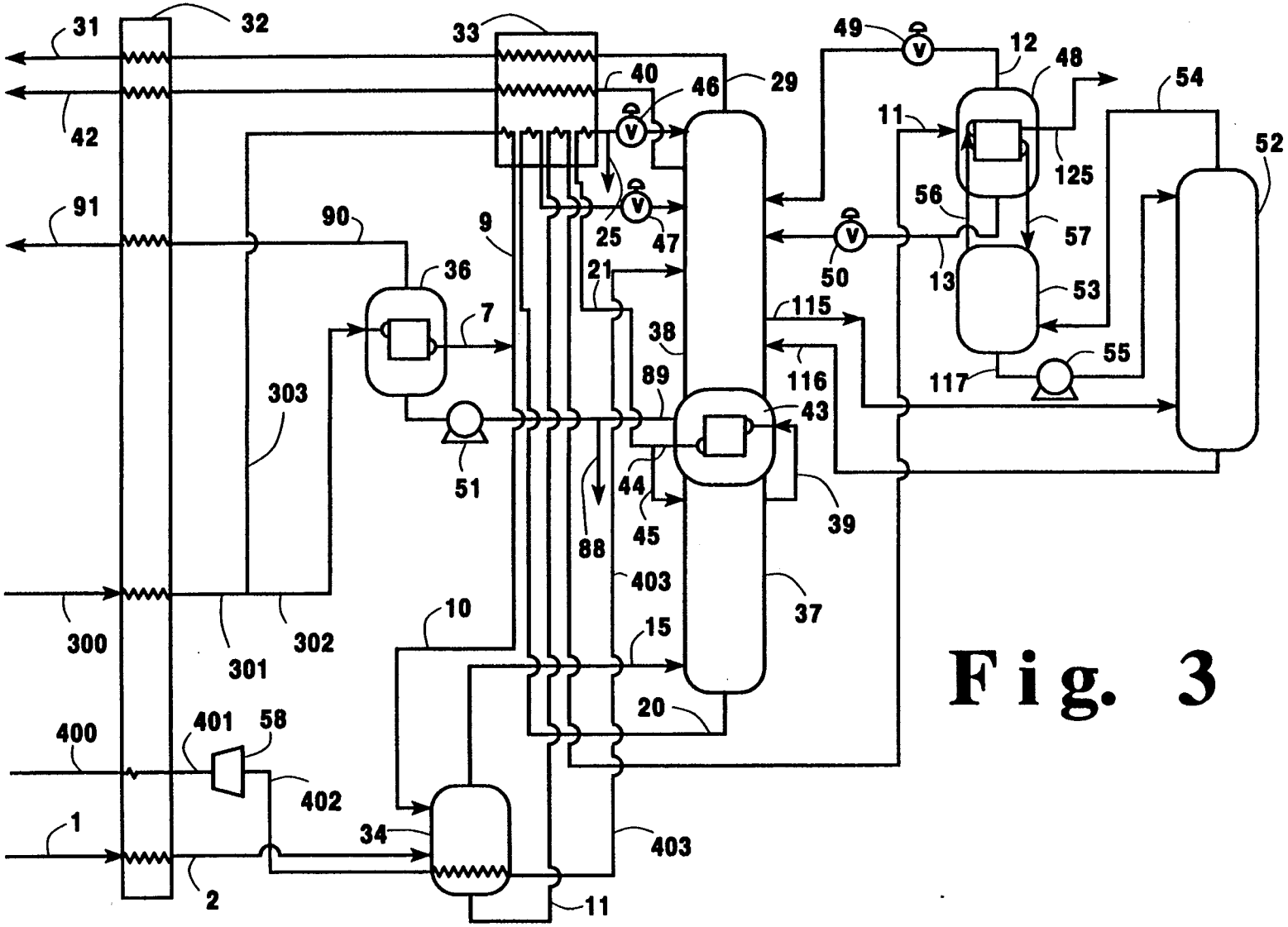
Figures 4, 5:
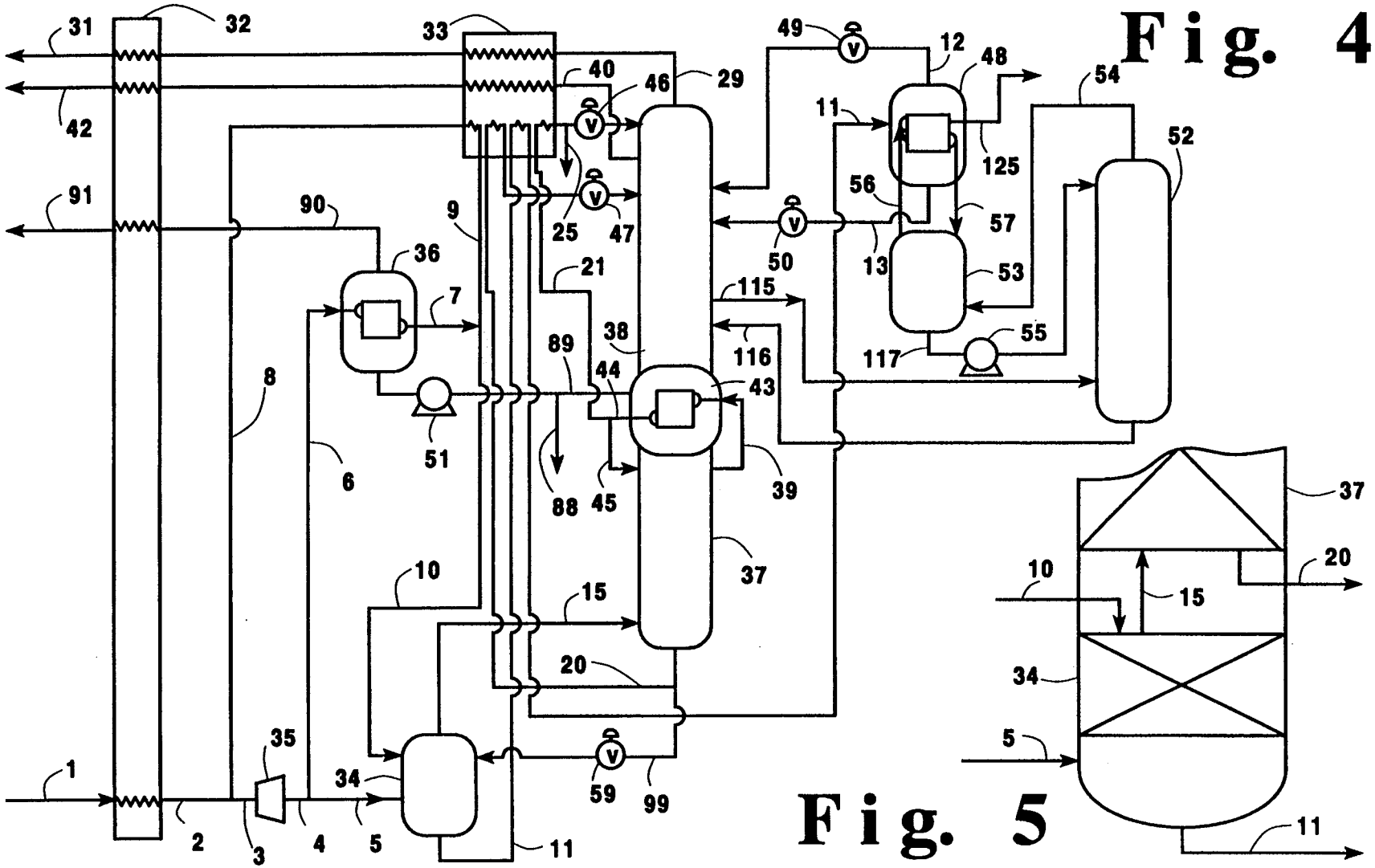
FIG. 5 is a simplified cross-sectional representation of certain aspects of another embodiment of the invention wherein the stripping column is incorporated within the shell which houses the high pressure column.

FIGS. 2–4 illustrate other preferred embodiments of the invention. The numerals in the drawings are the same for the common elements and these common elements will not be described in detail a second time.

Referring now to FIG. 2, there is illustrated an embodiment wherein the feed air to product boiler 36 does not come from the feed air turboexpanded through turboexpander 35. In this embodiment a second feed air stream 300 is cooled by passage through main heat exchanger 32. Resulting stream 301 is divided into stream 303 which is liquefied in heat exchanger 33 and emerges as stream 9, and into stream 302 which is passed into product boiler 36 and emerges as stream 7. Stream 303 comprises from about 0 to 10 percent of the total feed air passed into the system, i.e., streams 1 and 300, and stream 302 comprises from about 20 to 45 percent of the total feed air passed into the system.

In the embodiment illustrated in FIG. 3 the feed air stream employed as vapor upflow in the stripping column is not turboexpanded. In this embodiment another feed air stream 400 is cooled by passage through main heat exchanger 32 and resulting stream 401 is turboexpanded through turboexpander 58. Turboexpanded stream 402 is further cooled by indirect heat exchange with boiling liquid in the lower portion of stripping column 34 and then passed as stream 403 into lower pressure column 38. In this embodiment the turboexpanded feed air stream comprises from about 0 to 15 percent of the total feed air passed into the system, i.e. streams 1, 300 and 400, and the gaseous feed air passed into the stripping column comprises from about 50 to 80 percent of the total feed air passed into the system.

In the embodiment illustrated in FIG. 4 a portion 99 of the oxygen-enriched kettle liquid from higher pressure column 37 is passed through valve 59 and into the upper portion of stripping column 34. This enables an increase in the flowrate of stream 11 which is advantageous if the argon column top condenser refrigeration requirement is high.

FIG. 5 illustrates, in pertinent part, an alternative embodiment of the invention wherein the stripping column is incorporated within the same column shell as is the higher pressure or first column. The operation of this embodiment is functionally the same as the other embodiments and thus will not be described again in detail. The numerals in FIG. 5 correspond to those of FIG. 1 and identify similar functions.

Now by the use of the present invention one can carry out cryogenic air separation with greater efficiency by reducing the thermodynamic irreversibility of the argon column top condenser and the lower pressure column. Although the invention has been described in detail with respect to certain preferred embodiments, those skilled in the art will recognize that there are other embodiments of the invention within the spirit and the scope of the claims.

We claim:

1. A method for the cryogenic rectification of feed air employing a double column main plant, comprising a higher pressure column and a lower pressure column, and an argon column having a top condenser, comprising:

(A) condensing a portion of the feed air to produce liquid feed air;

(B) passing liquid feed air and gaseous feed air into a stripping column and passing liquid feed air against gaseous feed air in the stripping column to produce stripping column product gas, having a nitrogen concentration which exceeds that of air, and stripping column product liquid, having an oxygen concentration which exceeds 25 mole percent;

(C) passing stripping column product gas into the higher pressure column for separation by cryogenic rectification;

(D) at least partially vaporizing stripping column product liquid by indirect heat exchange with argon-containing fluid in the argon column top condenser to produce oxygen-containing gas; and (E) passing oxygen-containing gas into the lower pressure column for separation by cryogenic rectification.

2. The method of claim 1 wherein the condensed feed air portion comprises from 20 to 45 percent of the total feed air employed.

3. The method of claim 1 wherein the feed air portion is condensed by indirect heat exchange with liquid oxygen taken from the lower pressure column.

4. The method of claim 1 wherein the gaseous feed air is turboexpanded prior to being passed into the stripping column.

5. The method of claim 1 further comprising passing a feed air stream in indirect heat exchange with liquid within the stripping column and thereafter passing said feed air stream into the lower pressure column.

6. The method of claim 1 wherein the stripping column product liquid is subcooled prior to being at least partially vaporized by indirect heat exchange with argon-containing fluid.

7. The method of claim 1 wherein the stripping column product liquid has an oxygen concentration which exceeds 33 mole percent.

8. The method of claim 1 further comprising recovering at least one of (i) product nitrogen taken from the lower pressure column, (ii) product oxygen taken from the lower pressure column, and (iii) product argon taken from the argon column top condenser.

9. A cryogenic rectification apparatus comprising:

(A) a double column main plant comprising a first column and a second column, and an argon column having a top condenser;

(B) a stripping column, means for passing liquid into the upper portion of the stripping column, and means for passing gas into the lower portion of the stripping column;

(C) means for passing fluid from the upper portion of the stripping column into the first column;

(D) means for passing fluid from the lower portion of the stripping column into the top condenser; and (E) means for passing fluid from the top condenser into the second column.

10. The apparatus of claim 9 further comprising a product boiler, means for passing liquid from the second column into the product boiler, and means for passing liquid from the product boiler into the stripping column said means comprising the means for passing liquid into the upper portion of the stripping column.

11. The apparatus of claim 9 further comprising a turboexpander and means for passing gas from the turboexpander into the stripping column.

12. The apparatus of claim 9 wherein the means for passing fluid from the lower portion of the stripping column into the top condenser comprises a subcooler.

13. The apparatus of claim 9 wherein the mass transfer internals of the argon column comprise structured packing.

14. The apparatus of claim 13 wherein the argon column comprises at least 150 equilibrium stages.

15. The apparatus of claim 14 wherein the argon column is in two parts.

16. The apparatus of claim 9 wherein the stripping column and the first column are incorporated within the same column shell.

* * * * *